US010119332B1

(12) United States Patent
Schellens

(10) Patent No.: US 10,119,332 B1
(45) Date of Patent: Nov. 6, 2018

(54) LADDER RUNG SUPPORTED UTILITY PLATFORM

(71) Applicant: Thomas E. Schellens, Old Lyme, CT (US)

(72) Inventor: Thomas E. Schellens, Old Lyme, CT (US)

( * ) Notice: Subject to any disclaimer, the term of this patent is extended or adjusted under 35 U.S.C. 154(b) by 67 days.

(21) Appl. No.: 14/529,028

(22) Filed: Oct. 30, 2014

(51) Int. Cl.
*E06C 7/16* (2006.01)

(52) U.S. Cl.
CPC ..... *E06C 7/165* (2013.01)

(58) Field of Classification Search
CPC ..... E06C 7/14; E06C 7/164; B44D 3/14
See application file for complete search history.

(56) References Cited

U.S. PATENT DOCUMENTS 407,079 A * 7/1889 Laskey ..... E06C 7/16 182/121
2,541,434 A * 2/1951 Nelson ..... E06C 7/14 192/105 BB
2,846,173 A * 8/1958 Grovesteen ..... B44D 3/14 248/210
3,029,054 A * 4/1962 Mott ..... E06C 7/14 248/211
3,052,442 A * 9/1962 Rankin, Jr. ..... E06C 7/14 248/210
3,239,181 A * 3/1966 Ellerbrock ..... B44D 3/14 248/210
3,278,148 A * 10/1966 Denaro ..... B44D 3/14 211/73
3,822,846 A * 7/1974 Jesionowski ..... B05C 21/00 15/257.06
3,899,045 A * 8/1975 Geisel ..... E06C 7/16 182/121
3,979,097 A * 9/1976 Balne ..... E06C 7/14 182/129
3,980,264 A * 9/1976 Tomasik ..... E06C 7/14 248/110
3,987,993 A * 10/1976 Hopkins ..... E06C 7/14 248/110
4,032,100 A * 6/1977 Kahn ..... E06C 7/14 248/211
4,424,949 A * 1/1984 Kimmett ..... B05C 21/00 15/257.06
4,445,659 A 5/1984 LaChance ..... 248/210
4,560,127 A * 12/1985 Ippolito ..... E06C 7/14 182/106

(Continued)

FOREIGN PATENT DOCUMENTS

GB 2094874 A * 9/1982 ..... E06C 7/14
GB 2094874 A * 9/1982 ..... E06C 7/14

*Primary Examiner* — Katherine W Mitchell
*Assistant Examiner* — Candace L Bradford
(74) *Attorney, Agent, or Firm* — Fattibene and Fattibene LLC; Paul A. Fattibene

(57) ABSTRACT

A compact folding utility platform having a rung attachment attaching to the rung. A shelf folds from a vertical support, forming a work platform. A rung attachment is attached to the vertical support. In one embodiment, the rung attachment expands inside the rung of a ladder and is frictionally retained. In another embodiment, a rung attachment mechanism having fingers pivotally moves into position around the rung. Tabs placed in the vertical support may be used to hold the handle of a paint can. Other work tools may be placed on the shelf.

6 Claims, 18 Drawing Sheets

(56) References Cited

U.S. PATENT DOCUMENTS 4,687,075 A 8/1987 Skaggs ..... 182/121
4,824,060 A * 4/1989 Korda ..... E06C 7/143 182/129
4,911,265 A * 3/1990 Skaggs ..... E06C 7/16 182/121
4,979,710 A * 12/1990 Baldwin ..... E06C 7/14 248/210
5,031,723 A 7/1991 Hooten ..... 182/129
5,052,581 A 10/1991 Christ et al. ..... 220/570
5,079,795 A * 1/1992 Schmid ..... B44D 3/126 15/257.06
5,191,954 A 3/1993 Ledford ..... 182/129
5,236,161 A * 8/1993 Haven ..... E06C 7/14 182/129
5,275,256 A * 1/1994 Ellzey ..... E06C 7/14 104/246
5,429,205 A * 7/1995 Collins ..... E06C 7/14 182/122
5,431,249 A * 7/1995 Tredup ..... E06C 7/14 182/122
5,507,363 A * 4/1996 Tredup ..... 182/129
5,687,941 A * 11/1997 Quintile ..... E06C 7/14 248/210
6,148,958 A * 11/2000 Ahl ..... E06C 7/14 182/121
6,824,115 B1 11/2004 Baston ..... 248/238
7,845,469 B1 12/2010 Butler et al. ..... 182/129
2001/0052437 A1* 12/2001 MacSweeney ..... E06C 7/14 182/129
2005/0056485 A1* 3/2005 Tarlow ..... E06C 7/14 182/129
2009/0250294 A1* 10/2009 Byers ..... E06C 7/14 182/129
2011/0203873 A1* 8/2011 Perry ..... E06C 7/14 182/129
2012/0187266 A1* 7/2012 Schirmacher ..... E06C 7/14 248/238

* cited by examiner

LADDER RUNG SUPPORTED UTILITY PLATFORM

FIELD OF THE INVENTION

The present invention relates in general to a utility platform or shelf attached to a ladder for holding materials such as paint to be used while working on the ladder, and more particularly to a utility platform with a secure rung attachment means.

BACKGROUND OF THE INVENTION

In many trades, it is often necessary to use a ladder to reach elevated locations for performing work, such as painting. It is often difficult to hold onto the ladder while also trying to hold or use the various tools or paint cans utilized at the elevated location. This need for holding and having readily available the various tools or paint cans needed to perform the work at the higher elevation is solved in many ways by a plethora of different accessories attached to the ladder. Many of these have been relatively complex, have been difficult to carry, and are often not securely attached to the ladder so as to prevent movement.

A ladder tray is disclosed in U.S. Pat. No. 4,445,659 entitled "Combination Bracket and Adjustable Ladder Tray" issuing to Lachance on May 1, 1984. Therein disclosed is a combination bracket and adjustable ladder tray for holding tools and material in close proximity to the work area. The tray is supported by pipes extending within the hollow rungs of the extension ladder. The tray is adjustable so that it can always be level relative to the ground.

Another ladder accessory is disclosed in U.S. Pat. No. 5,031,723 entitled "Ladder Accessories" issuing to Hooten on Jul. 16, 1991. Therein disclosed is a device adapted to attach to a ladder to enhance balance and stability and provide support for equipment, tools and supplies. A rigid shaft utensil support is inserted through the rung of the ladder to support tools, equipment and supplies.

Yet another ladder rung supported platform is disclosed in U.S. Pat. No. 5,191,954 entitled "Ladder Rung Supported Combination Platform and Utensil Rack" issuing to Ledford on Mar. 9, 1993. Therein disclosed is a ladder platform and utility frame having a footplate supported by an adjacent ladder rung. A stub arm and lug attached to the utensil frame and the footplate stabilize the utensil frame in a substantially horizontal plane.

While many of the prior ladder accessories have utilized the rungs of a ladder to provide support, they are generally relatively complex and have many different parts that are difficult to carry and often difficult to assemble and attach to a ladder. Additionally, many of these prior ladder platforms or racks have been difficult to level and are difficult to use. Many of the prior ladder accessories also do not easily and securely attach to the ladder.

Therefore, there is a need for a convenient utility platform that is compact and easily carried and that securely attaches to a ladder.

SUMMARY OF THE INVENTION

The present invention relates to a utility platform that is compact and easily and securely attached to a ladder. The present invention comprises a utility platform assembly having a secure rung attachment means. A shelf pivotally folds from a vertical support. The vertical support holds a rung attachment means that is inserted partially into the rung of a ladder. The rung attachment means is attached above the center of gravity of the utility platform assembly, permitting the utility platform to be self-leveling. The rung attachment means has an expanding plug that expands once inserted into the rung of the ladder so as to securely hold the utility platform assembly to the ladder.

In another embodiment of the utility platform assembly of the present invention a fingered rung grip is used to attach it to a rung of a ladder. A handle arm pivots upward permitting a handle and rung grip support to be replaced over the rung of the ladder. After placement of the handle and rung grip support over the rung of the ladder the handle arm pivots downward locking the utility platform assembly onto the rung of the ladder.

In yet another embodiment of the utility platform assembly of the present invention another rung attachment mechanism is used. In this embodiment a handle is moved away from a user to lock the rung attachment mechanism onto the rung of a ladder.

Accordingly, it is an object of the present invention to provide a compact, easily carried utility platform for use with a ladder.

It is another object of the present invention to provide a utility platform that easily and securely attaches to a hollow rung of a ladder.

It is an advantage of the present invention that it is foldable and easily carried.

It is a further advantage of the present invention that it is self-leveling.

It is a feature of the present invention that the rung attachment means securely attaches to an internal space of the rung of the ladder.

It is a further feature of the present invention that a plug is expanded to frictionally attach to a surface on the internal space of the rung of the ladder.

It is a further feature of the present invention that it folds into a compact, easily carried package.

It is yet another feature of the present invention that a tab securely holds the handle of a paint can.

It is an object of an embodiment of the present invention to securely and easily attach to a rung of a ladder.

It is an advantage of an embodiment of the present invention that it is easily and securely attached to a rung of the ladder.

Is a feature of an embodiment of the present invention that a rung attachment mechanism is secured to the exterior of a rung of the ladder.

It is another feature of an embodiment of the present invention that a handle arm pivots causing fingers to engage the rung of the ladder securely holding the utility platform assembly securely.

It is an object of another embodiment of the present invention to securely locked a rung attachment mechanism onto the rung of a ladder in a handle is moved in a direction away from the user.

It is an advantage of another embodiment of the present invention that a handle is positioned away from a user and adjacent the ladder providing more usable workspace on a shelf.

Is a feature of another embodiment of the present invention that a pivot point of a handle arm used for locking a rung attachment mechanism onto the rung of a ladder is located below the rung of the ladder.

These and other objects, advantages, and features will become readily apparent in view of the following more detailed description.

DETAILED DESCRIPTION OF THE PREFERRED EMBODIMENT

Figure 1:
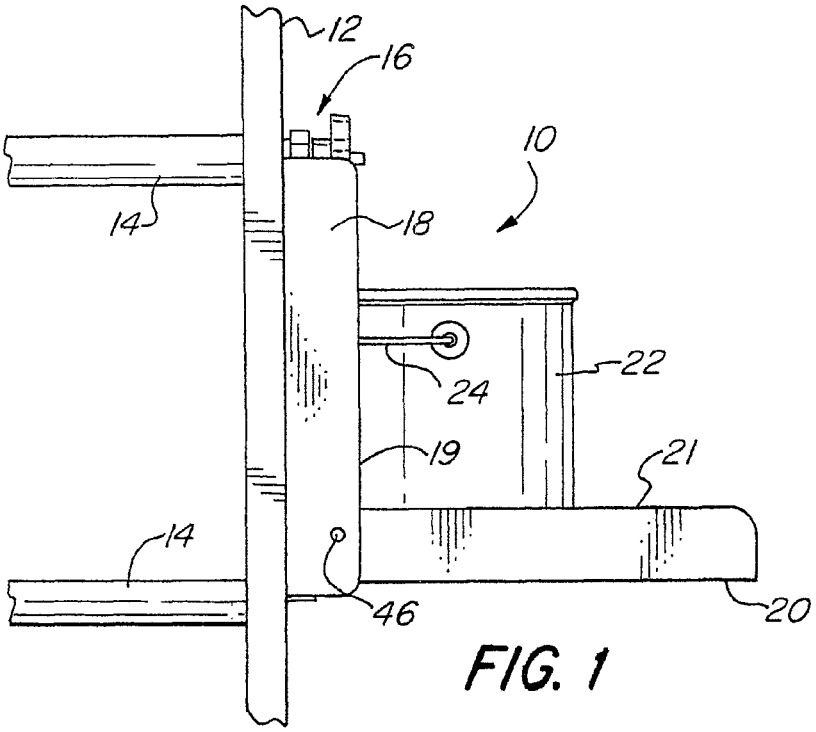
FIG. 1 is a front elevational view schematically illustrating the utility platform of the present invention attached to a ladder and holding a paint can.

FIG. 1 schematically illustrates the utility platform assembly 10 of the present invention. A ladder formed with parallel side rails 12 has a plurality of rungs 14 perpendicularly attached to the side rails. The rungs 14 are generally hollow tubes or cylinders having an internal space. Rung attachment means 16 is inserted into the internal space of the rung 14. Rung attachment means 16 is attached to a vertical support 18. The vertical support 18 has a perpendicular vertical sidewall 19. A shelf 20 is pivotally attached to the vertical support 18 by pivot 46. The shelf 20 has a perpendicular horizontal sidewall 21. A work piece, such as a paint can 22, may be placed on the extended shelf 20. The paint can 22 may have a handle 24.

Figure 2:
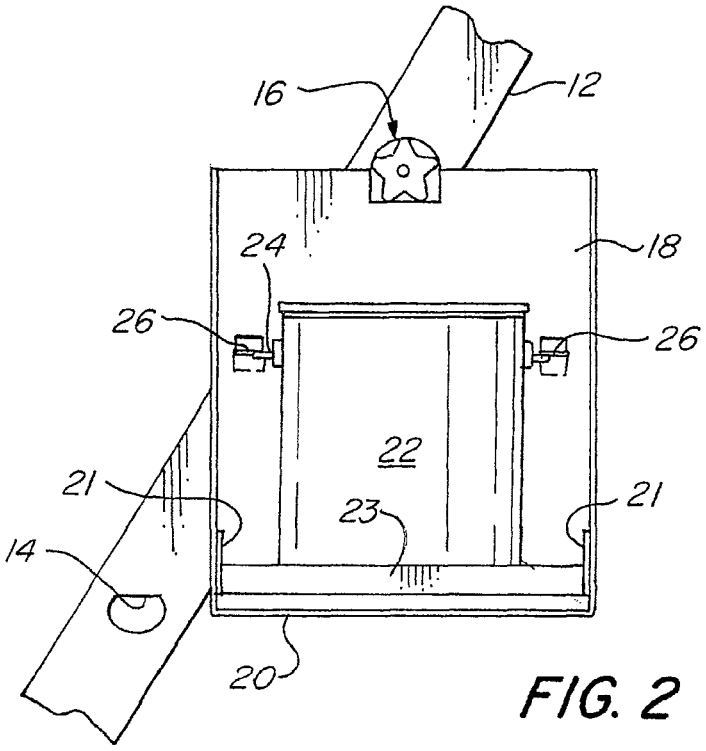
FIG. 2 is a side elevational view illustrating the utility platform of the present invention attached to a ladder.

FIG. 2 is a side elevational view schematically illustrating the present invention. Rung attachment means 16 is placed within the interior of the rung 14 of the ladder side rails 12. The vertical support 18 has tabs 26 that extend from the vertical support 18 so as to hold the handle 24 of the paint can 22. A lip 23 may extend perpendicularly upward from the shelf 20 so as to prevent articles or the paint can 22 from sliding off of the shelf 20. The lip 23 is shorter than the horizontal sidewall 21 so as not to interfere with rung attachment means 16 when folded.

Figure 3:
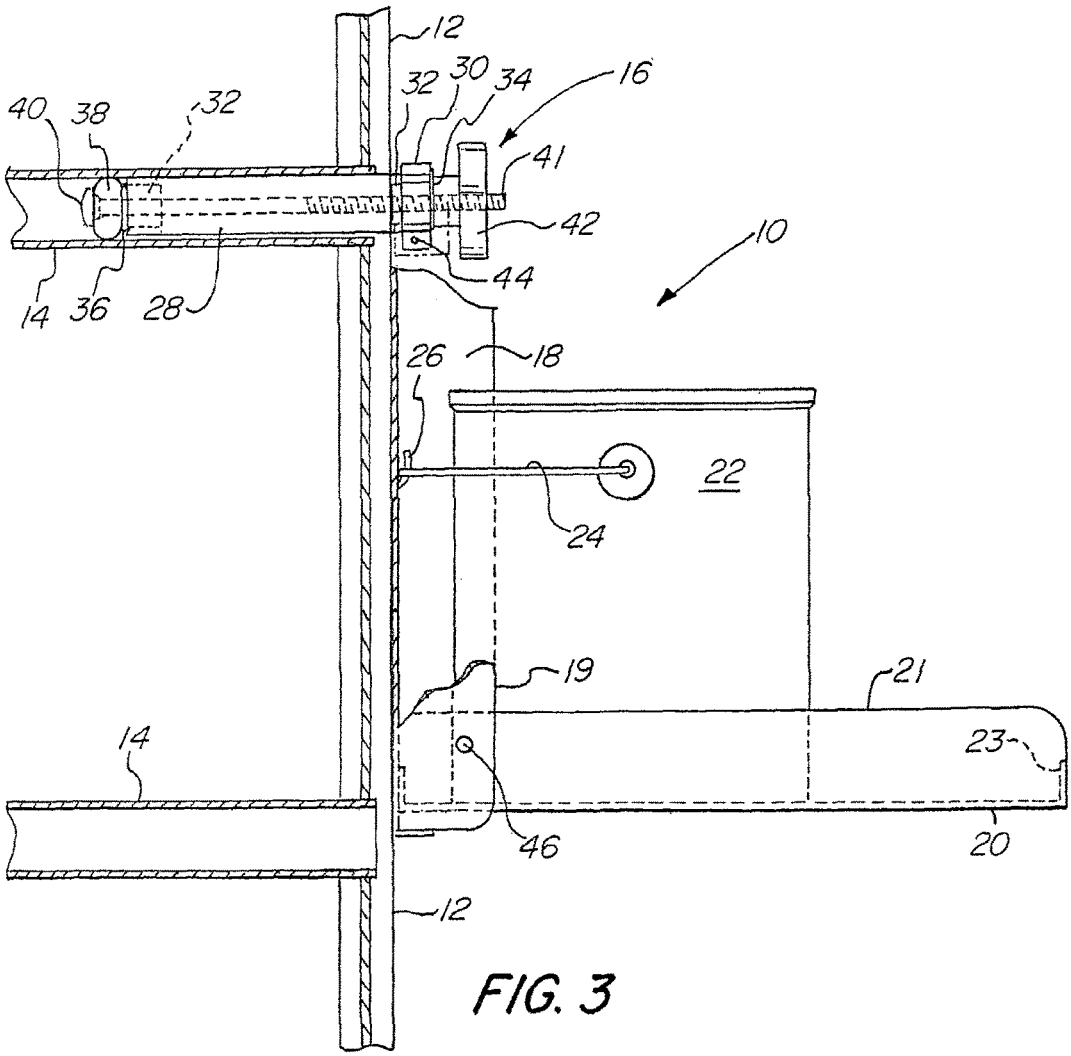
FIG. 3 is a partial cross-section more clearly illustrating the rung attachment means and the utility platform of the present invention.

FIG. 3 is a partial cross-section illustrating in greater detail rung attachment means 16. Rung attachment means 16 may comprise a tube 28 extending through a locking ring 30 attached to the vertical support 18. A portion of the vertical support 18 is illustrated as being cut away to more clearly show the structure of rung attachment means 16. Plugs 32 are fitted within each end of the tube 28. Adjacent one of the plugs 32 is a washer 34 and adjacent the other plug 32 is a washer 36. Adjacent washer 36 is a tapered rubber plug 38 that is capable of expanding when compressed. A bolt 40 is placed through the tapered rubber plug 38, the washer 16, the plugs 32, the tube 28, and the washer 34. The bolt 40 has threads 41 on one end. A threaded knob 42 is threaded onto the threaded end 41 of the bolt 40. The locking ring 30 is pivotally attached with a pivot pin 44 to the vertical support 18.

The operation of the present invention can readily be appreciated with respect to FIGS. 1 to 3. Rung attachment means 16 is initially configured so that the tapered rubber plug 38 is in an unexpanded state so that its outer dimension is less than that of the interior dimension of the rung 14. This is accomplished by turning knob 42 so that the distance between the head of the bolt 40 adjacent the tapered rubber plug 38 and the turning knob 42 is sufficiently long so that the tapered rubber plug 38 is not compressed and therefore has a reduced radial dimension. After insertion of rung attachment means 16 into the interior of the rung 14, the threaded knob 42 is rotated on the threads 41 of bolt 40, shortening the distance between the head of bolt 40 and the threaded knob 42, causing the tapered rubber plug 38 to expand. As the tapered rubber plug 38 expands laterally, it strikes and is wedged against the interior surface of the rung 14. This securely locks into place rung attachment means 16 and prevents the vertical support 18 and attached shelf from moving. Accordingly, the utility platform assembly 10 is securely fastened to the ladder side rail 12 creating a stable work platform. Rung attachment means 16 may be constructed so that after the shelf 20 is level rung attachment means 16 may be secured to hold the shelf 20 in a level position. Alternatively, rung attachment means 16 may be constructed so that after the rung attachment means 16 is secured the shelf 20 is permitted to pivot thereon so as to be continuously self leveling.

FIGS. 4A-D schematically illustrate the operation of the present invention and the ability for it to transform into a compact, folded assembly that may be easily and quickly unfolded to provided a secure, stable utility or work platform for attaching to a ladder.

Figure 4A:
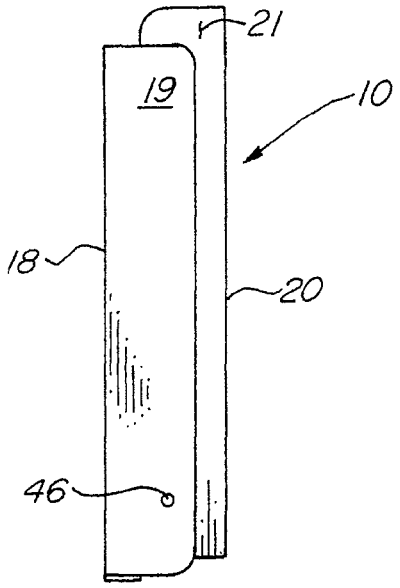
FIGS. 4A-D schematically illustrate the unfolding of the present invention prior to attachment to a ladder.

FIG. 4A illustrates the utility platform assembly 10 folded into a compact, secure, easily carried shape. The shelf 20 is pivoted on pivot 46 to mesh or nest within the vertical support 18.

Figure 4B:
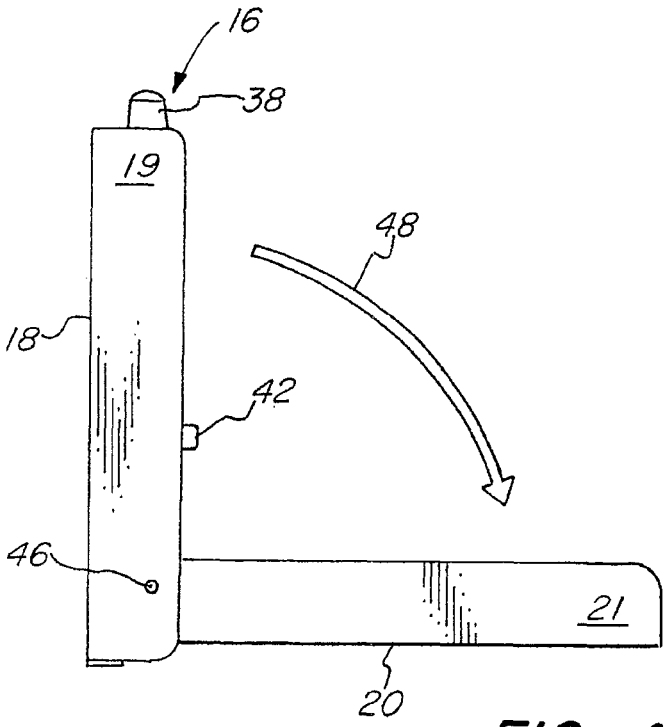

FIG. 4B illustrates the pivoting downward of the shelf 20 in the direction illustrated by arrows 48. Rung attachment means 16 is pivoted to extend alongside the vertical support 18. A portion of the threaded knob 42 and the tapered rubber plug 38 of rung attachment means 16 are illustrated.

Figure 4C:
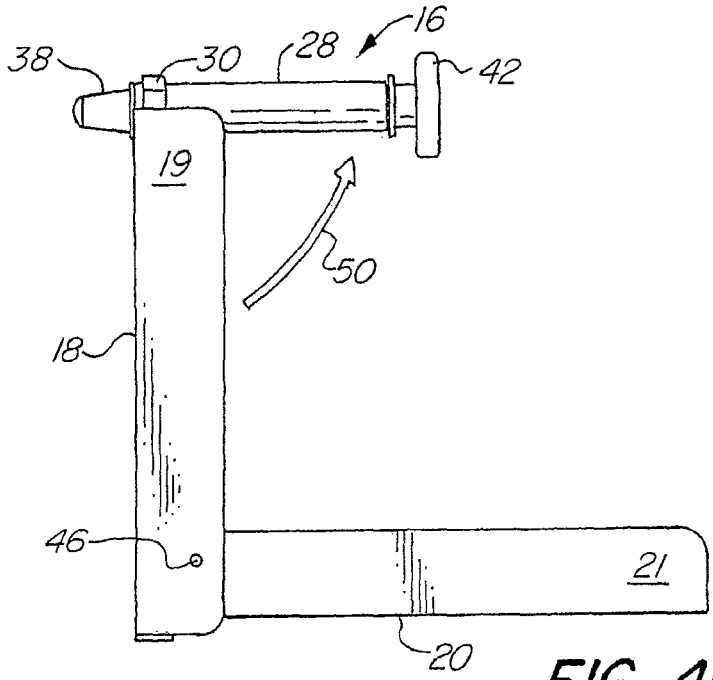

FIG. 4C illustrates the pivoting upward, by pivoting ring 30 in the direction of arrows 50, of rung attachment means 16. The major axis of rung attachment means 16 is now perpendicular to the major axis of the vertical support 18.

Figure 4D:
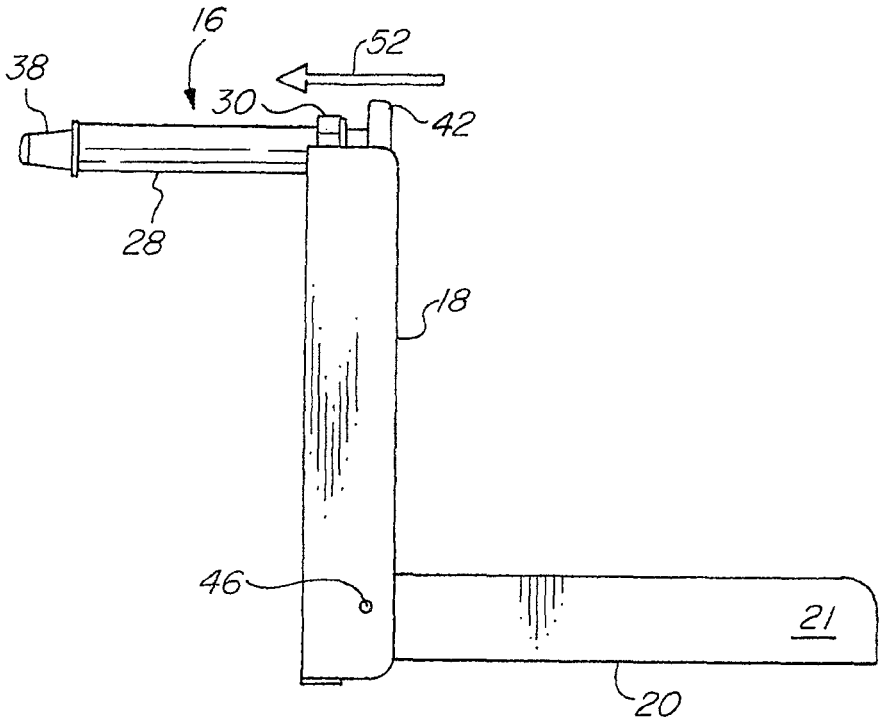

FIG. 4D illustrates extending rung attachment means 16 in the direction illustrated by arrow 52 so as to extend into a rung of a ladder. Ring 30 has an inside diameter sufficient to permit the tube 28 to slide there through. After insertion of the rung attachment means into the rung of a ladder, the threaded knob 42 is tightened, expanding the tapered rubber plug 38 so as to be frictionally retained within the interior of the rung of the ladder. After leveling the shelf 20, the ring 30 may be locked in position separately or by the tightening of the threaded knob 42, forcing the ring 30 forward so as to lock it into position. Therefore, the shelf 20 is securely attached to the ladder. Alternatively, the ring 30 may be constructed to permit the tube 28 to rotate freely permitting the shelf 20 to swing and be self leveling due to the center of gravity of the utility platform assembly being lower than pivot point.

FIGS. 5A-G and 6-7 illustrate another embodiment of the present invention. In this embodiment a rung grip is used to securely attach the utility platform assembly to the exterior of a rung of a ladder.

FIGS. 5A-G illustrate the operation of this embodiment of the present invention. The utility platform assembly 110 in this embodiment comprises a rung attachment mechanism 116 pivotally attached to a vertical support 118 and a shelf 120. A handle arm 119 is attached to a pivoting handle 128. The handle arm 119 is pivotally attached to a handle and rung grip support 168 and has a rung grip 160 on one end thereof. The handle and rung grip support 168 is integrally formed as part of the vertical support 118. The rung grip 160 is formed by a curved finger 154 having a distal end 156 and a proximal and 158. Pivoting on the proximal end 158 of the curved finger 154 is a top finger 164 attached by pivot pin 166. Opposing the top finger 164 is a bottom finger 162. The top and bottom fingers 164 and 162 are integrally formed as part of the handle arm 119. The shelf 120 is pivotally attached to the vertical support 118 by pivot pin 146. The shelf 120 has shelf side walls 121 around 3 sides thereof. A latch 170 may be formed on a shelf sidewall 121 of the shelf 122 hold the vertical support 118 adjacent thereto in a folded position. Therefore, the utility platform assembly 110 of this embodiment has a compact structure or form that is easily stored.

Figure 5A:
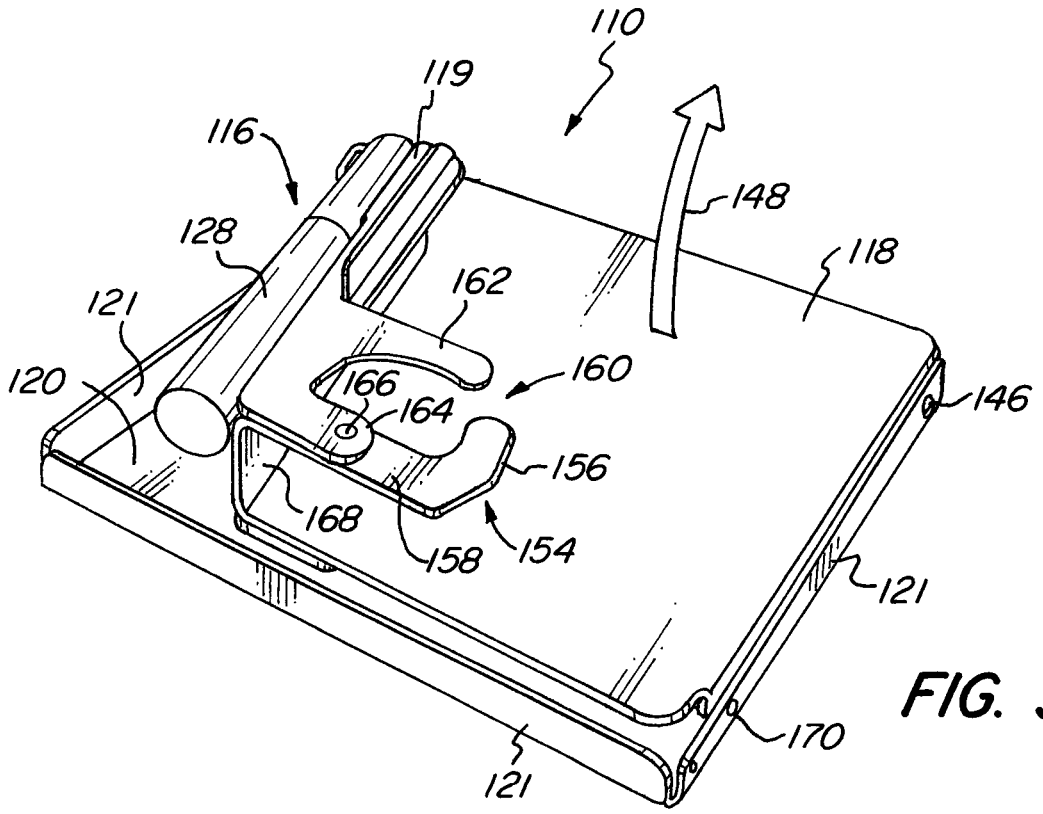
FIGS. 5A-G schematically illustrate an embodiment of the present invention in a sequence of operation and attachment to a ladder.
Figure 5B:
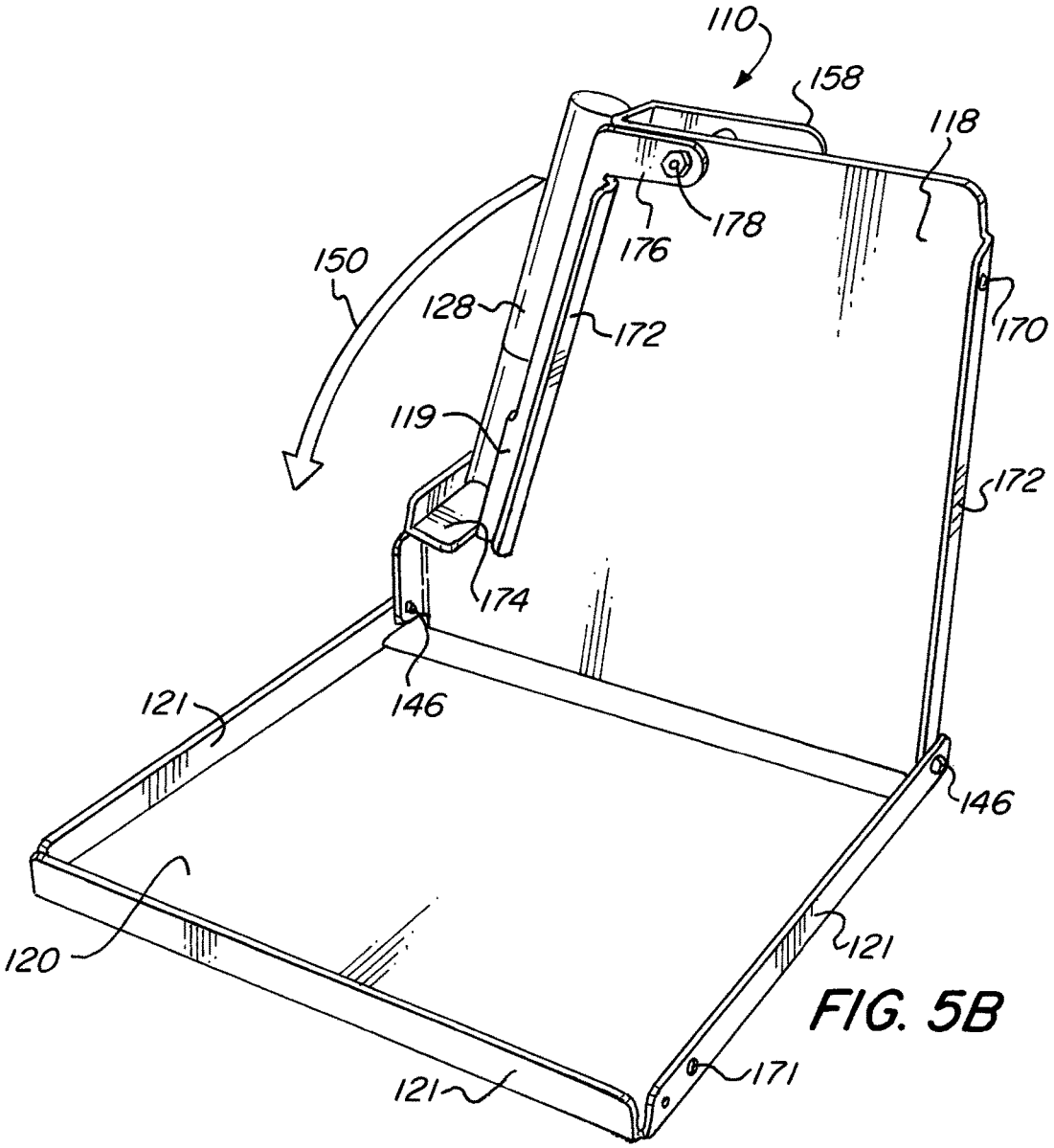

The operation and benefits of the present invention can readily be appreciated with reference to FIGS. 5A-G. In FIG. 5A arrow 148 represents the pivoting of the vertical support 118 relative to the shelf 120 about the pivoted pin 146. FIG. 5B illustrates the vertical support 118 in an open position perpendicular to the shelf 120. FIG. 5B better illustrates the hole 171 formed in shelf sidewall 121 and the latch 170 formed in vertical support sidewall 172 used to hold the vertical support 118 and shelf 120 in a closed position. The latch 170 may be a retained ball that mates with the hole 171. The handle arm 119 is pivotally attached to the vertical support 118 by pivot pin 178 in a leg 176 extending from the arm handle 119. Also formed on the handle arm 119 is a handle support 174. The handle 128 is pivotally attached to the handle support 174. Arrow 150 illustrates the pivoting downward of the handle 128 so as to rest onto the handle support 174.

Figure 5C:
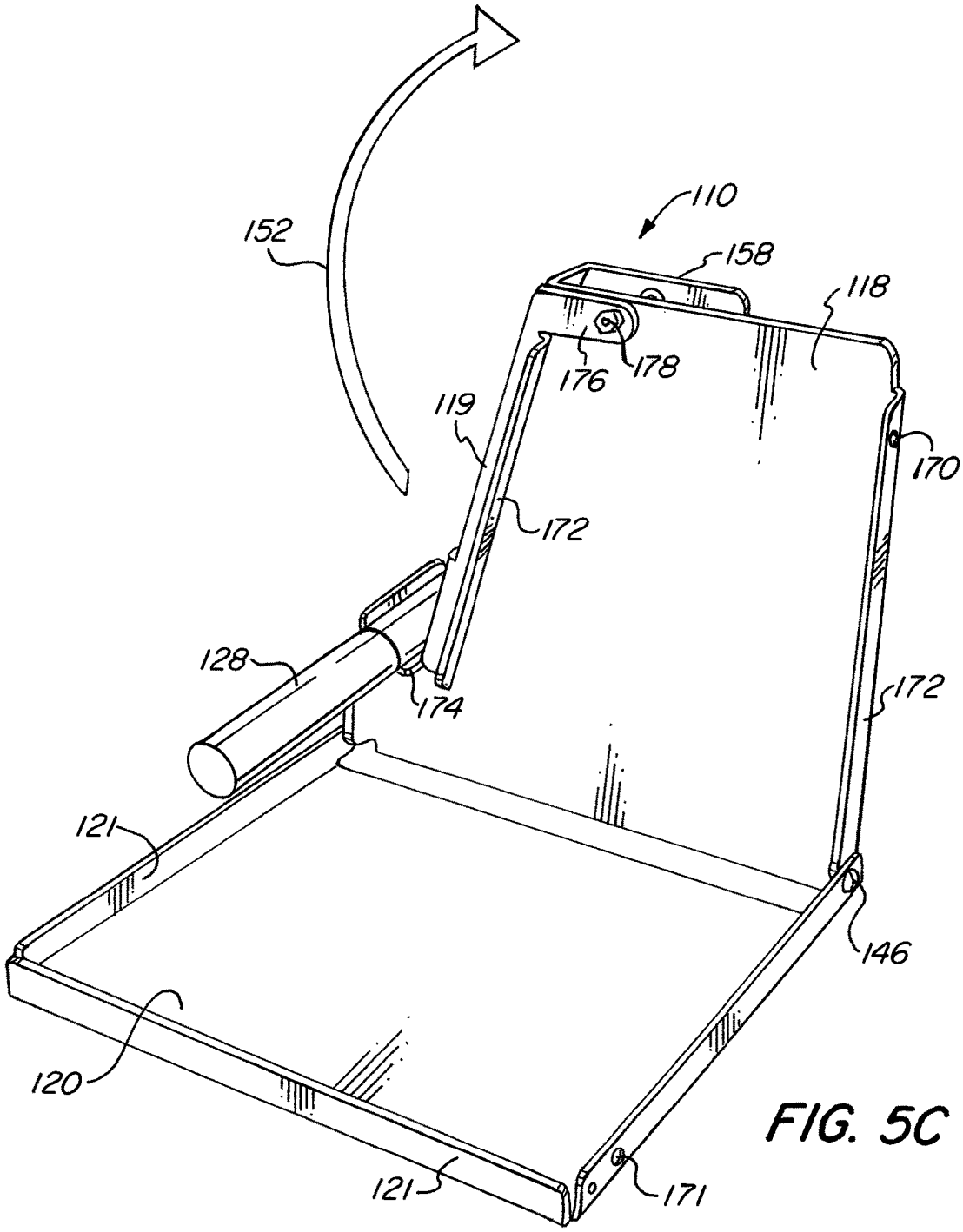
Figure 5D:
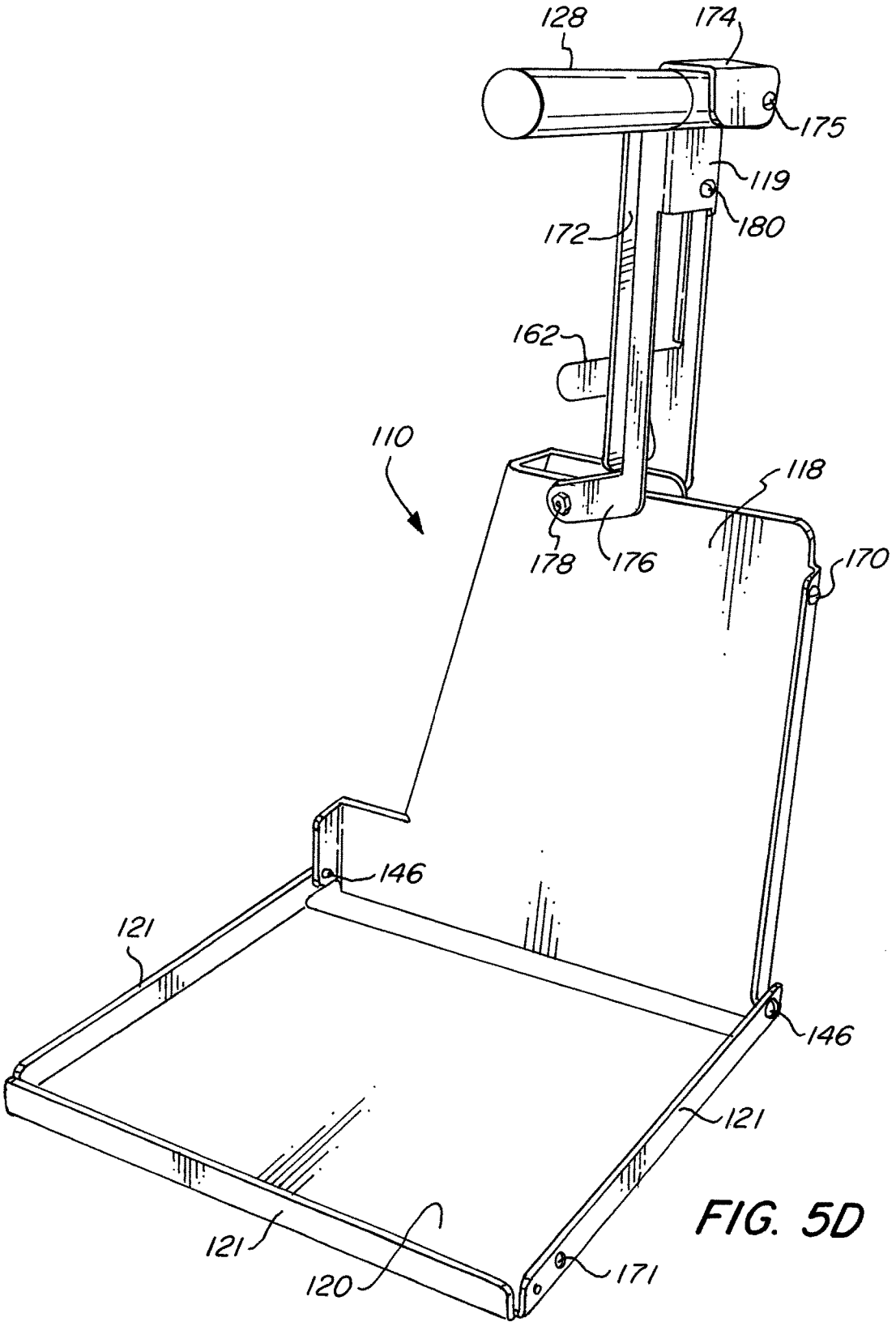
Figure 5E:
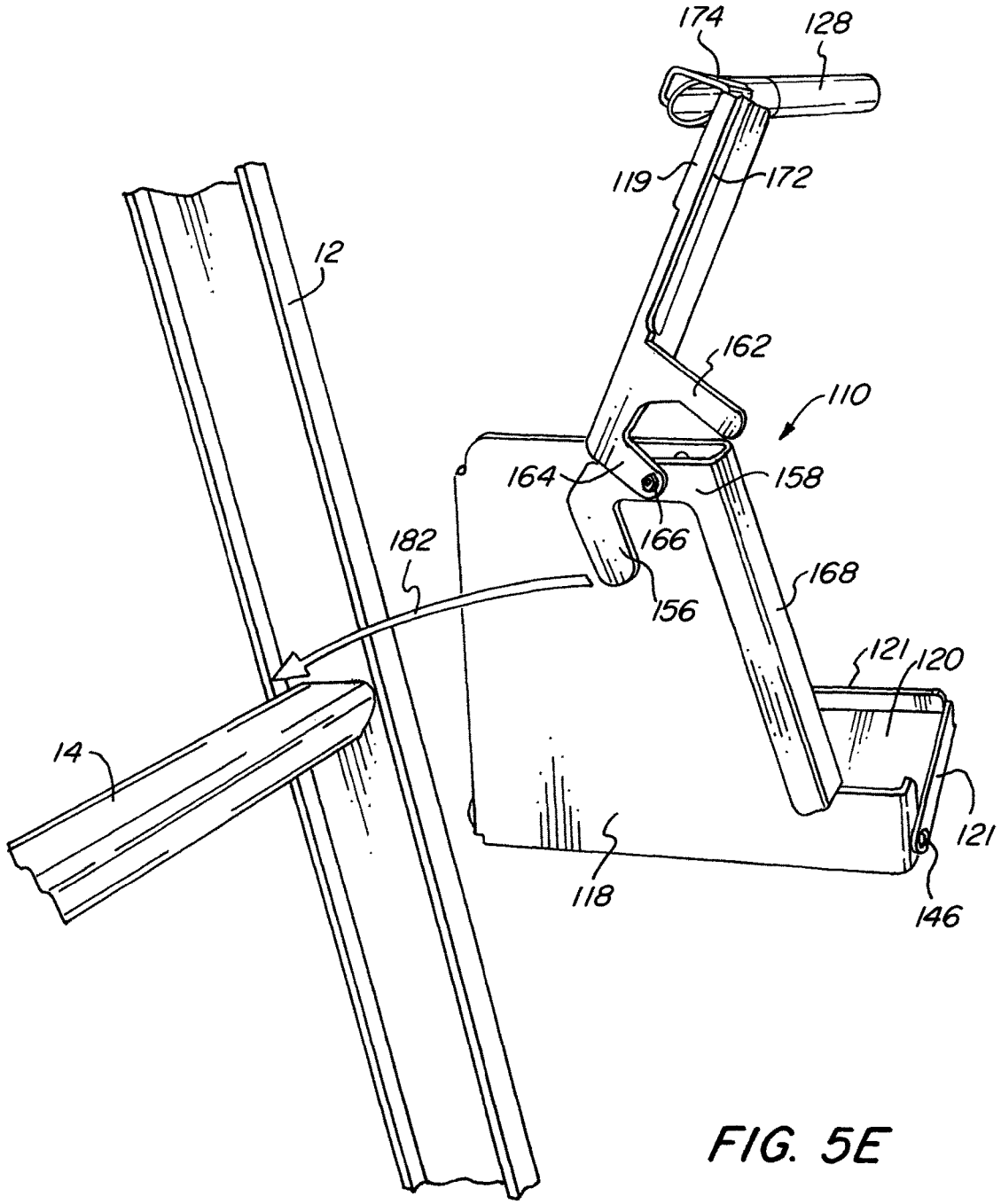
Figure 5F:
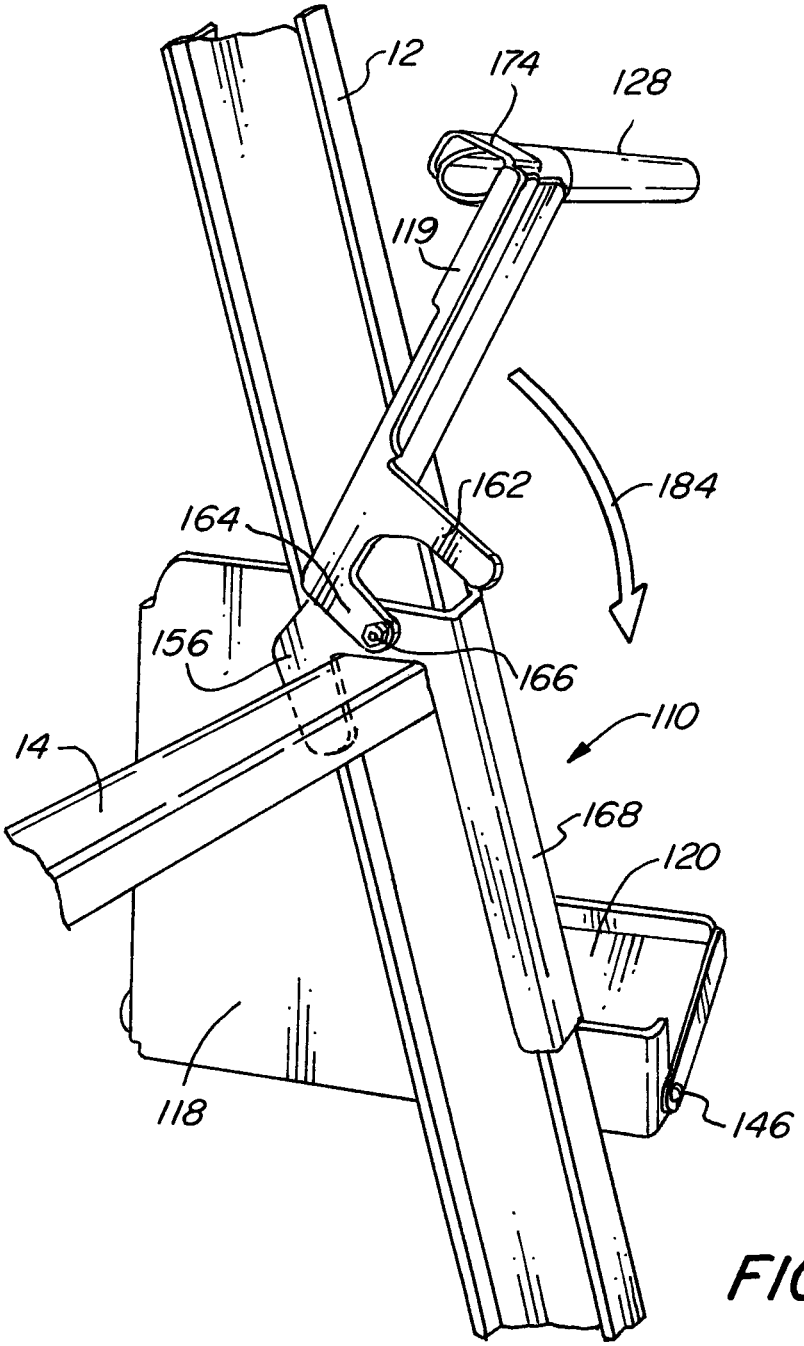
Figure 5G:
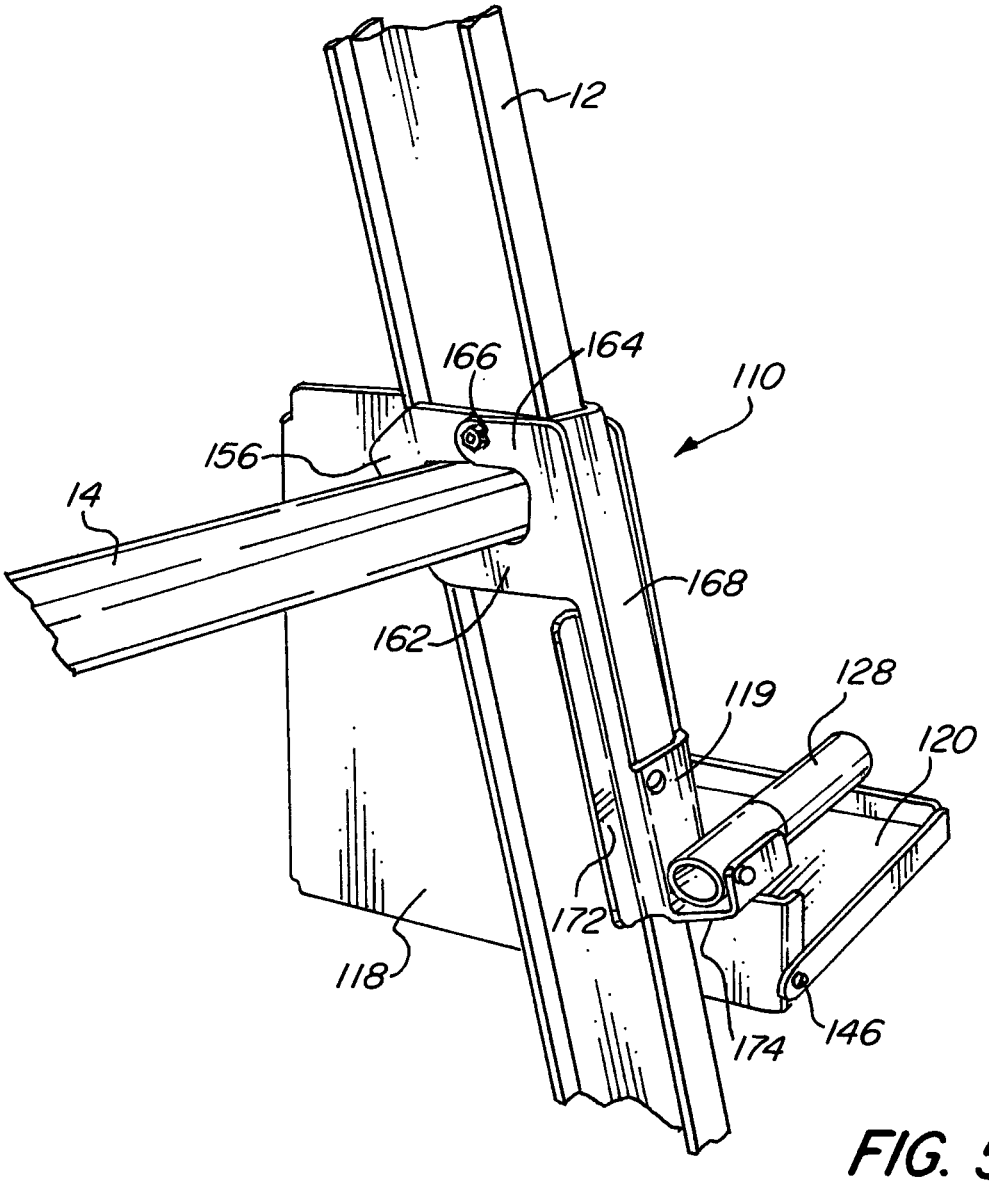

FIG. 5C illustrates the handle 128 in a down position so that the handle arm 119 may be raised upward as indicated by arrow 152. FIG. 5D illustrates the handle arm 119 raised upward raising the bottom finger 162 into an open position. FIG. 5E illustrates the placement of the utility platform assembly 110 onto a rung 14 of a ladder side rail 12. With the handle arm 119 in the up position the utility platform assembly 110 is moved into position in the direction of the arrow 182 so that the rung is placed between the distal end 156 and the handle and rung grip support 168 with the handle and rung grip support 168 resting against the ladder side rail 12. FIG. 5F illustrates the utility platform assembly 110 in position on the rung 14. To secure the utility platform assembly 110 in position the handle arm 119 is lowered in the direction of the arrow 184 so that the bottom finger 162 and top finger 164 wrap around the rung 14. FIG. 5G illustrates the utility platform assembly 110 locked in position on the rung 14 and ladder side rail 12.

Figure 6:
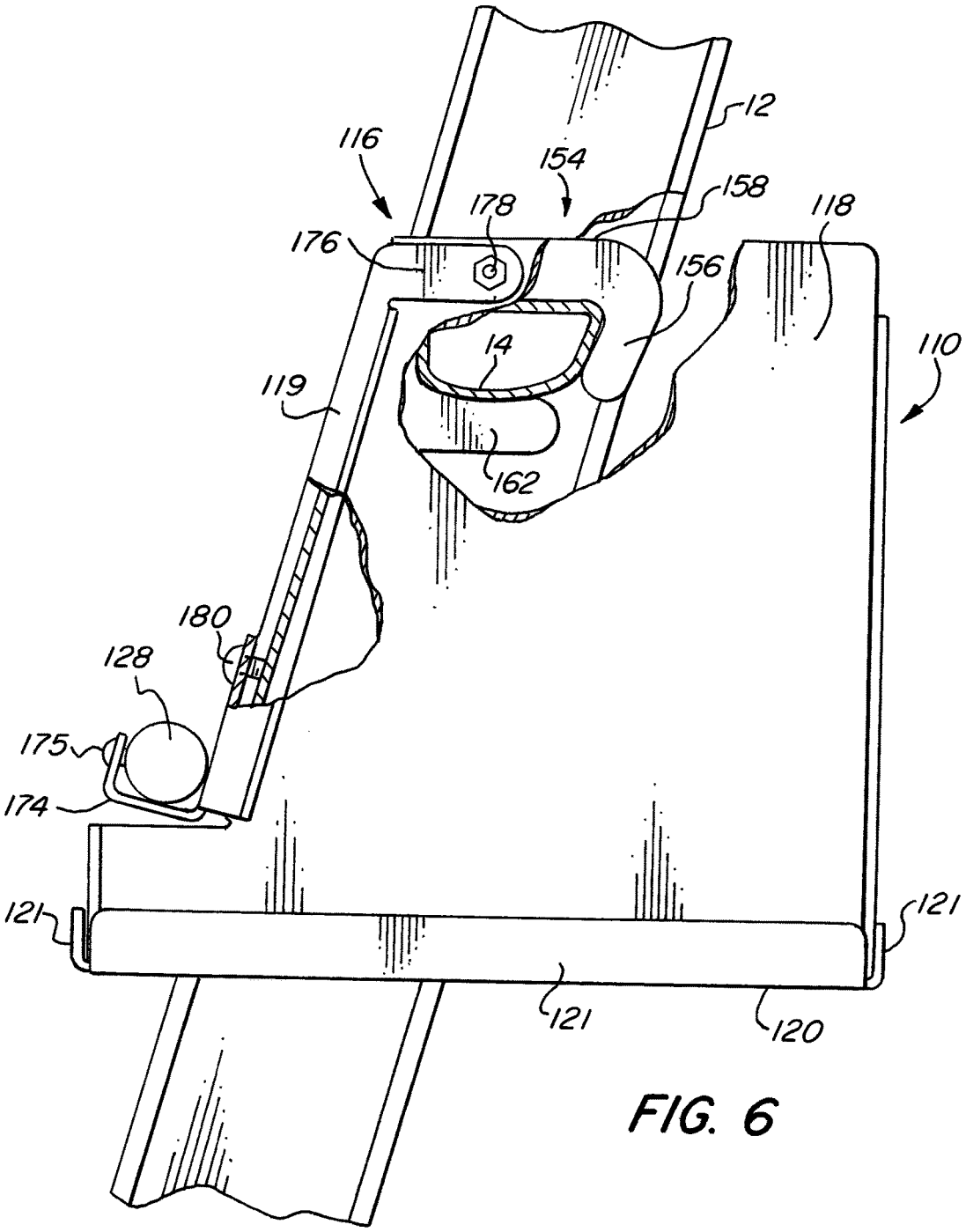
FIG. 6 is a partial cut-away elevational view schematically illustrating attachment of an embodiment of the present invention to a ladder.

FIG. 6 is an elevation a view with a partial cutaway illustrating the utility platform assembly 110 securely held on the ladder 12 and a rung 14. The rung attachment mechanism 116 circumscribes substantially the entire circumference of the rung 14. The rung 14 is nearly entirely circumscribed by the proximal end 158 and distal end 156 of the curved finger 154 and the bottom finger 162. A stop 180, which may be a screw, placed on the handle arm 119 may be used to adjust the positioning of the handle arm 119 relative to the ladder side rail 12.

Figure 7:
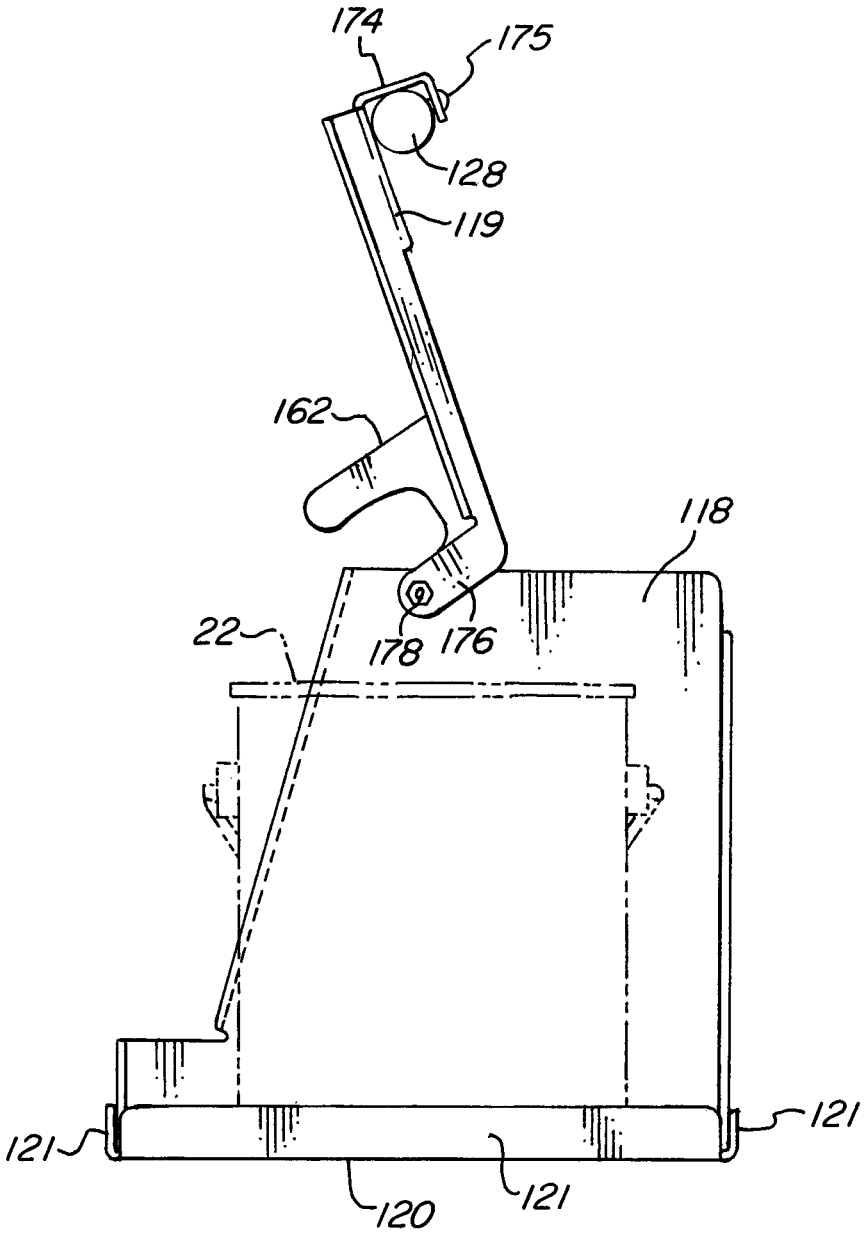
FIG. 7 is an elevational view schematically illustrating an embodiment of the present invention in a carrying mode.

FIG. 7 illustrates the utility platform assembly 110 being used to carry a paint can or other work piece 22 on the shelf 120. The handle arm 119 and the handle 128 pivot upward about the leg pivot 178 attached to the vertical support 118. The handle 128 is positioned over a center of the shelf 120 so as to balance the load of the paint can or work piece 22.

FIGS. 8-10C illustrate another embodiment of the present invention that has a slightly different rung attachment mechanism 216 than the rung attachment mechanism 116 of the embodiment illustrated in FIGS. 5A-7. In this embodiment the handle 228 is moved away from the user to lock the rung attachment mechanism 216 onto the rung 14 of the ladder side rail 12. The position of the handle 228 is modified to be positioned rearward or away from the user.

Figure 8A:
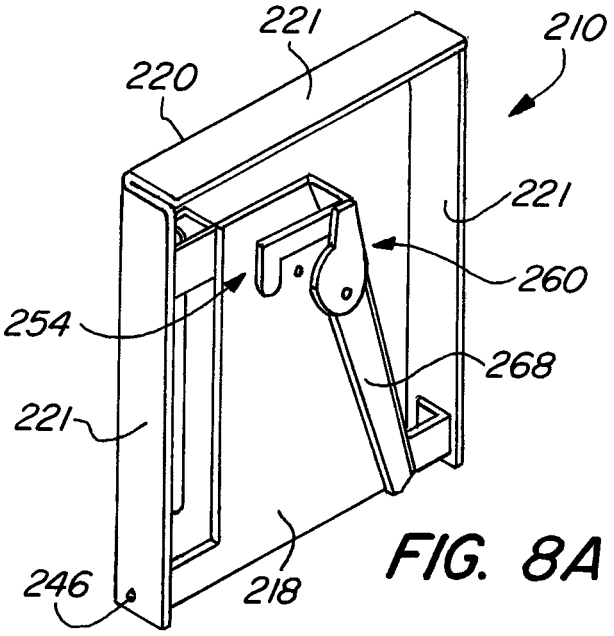
FIGS. 8A-B schematically illustrate another embodiment of the present invention in a folded position.
Figure 8B:
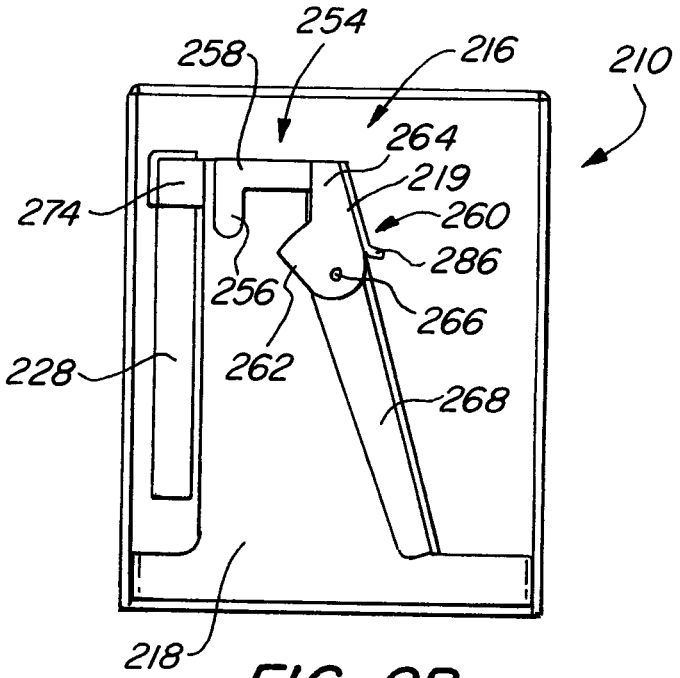

FIGS. 8A-B illustrate the utility platform assembly 210 of this other embodiment of the present invention in a closed or folded compact position that may be easily transported or stored. The utility platform assembly 210 in this embodiment has a rung attachment mechanism 216 attached to a vertical support 218. The vertical support 218 is pivotally attached to a shelf 220 by pivot pin 246. The shelf 220 has shelf side walls 221. A handle arm 219 is pivotally attached to a ladder and rung grip support 268. The handle arm 219 has formed thereon a bottom rung grip 264 and a top rung grip 264. Also formed on the handle arm 219 is a handle stop 286. Formed on and as part of the ladder and rung grip support 268 is a proximal end or palm 258 and a distal end or finger 256. The handle 228 is pivotally attached to a handle support 274 which is attached to the handle arm 219.

Figure 9A:
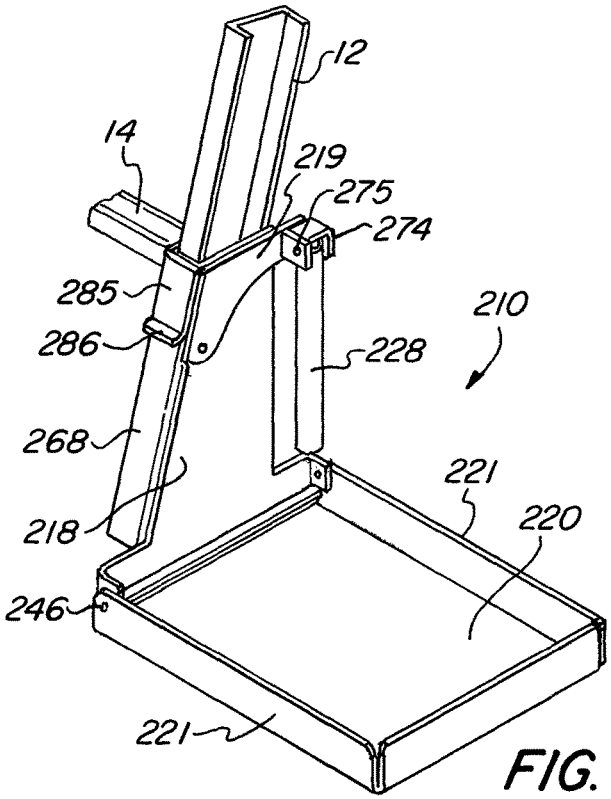
FIGS. 9A-C schematically illustrate another embodiment of the present invention on hold and attached to a ladder rung.
Figure 9B:
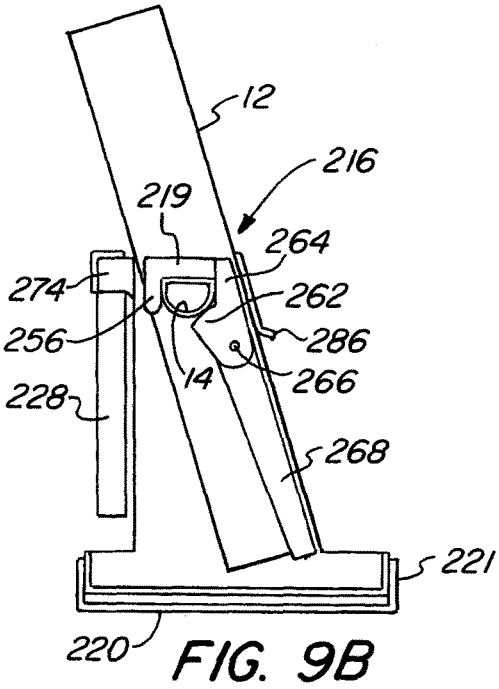
Figure 9C:
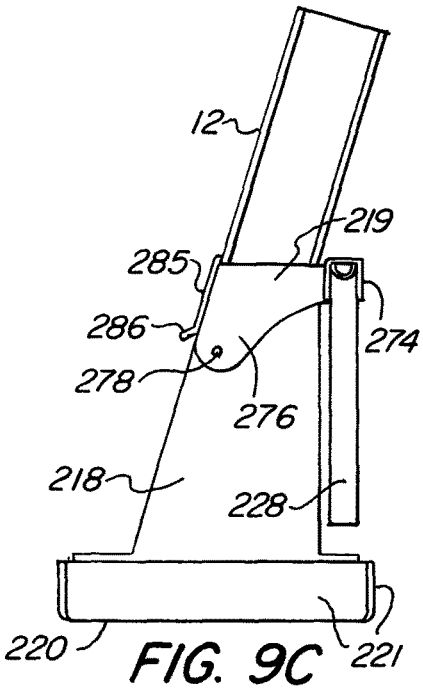

FIGS. 9A-C illustrate the utility platform assembly 210 attached to the rung 14 of a ladder side rail 12. The ladder and rung grip support 268 has a proximal end or palm 258 placed over the rung 14 of the ladder side rail 12. Distal end or finger 256 extends from the proximal end or palm 258 and contacts a side surface or portion of the rung 14. The top rung grip 264 and bottom rung grip 262 are pivoted in position about pivot 266 to securely attach to the rung 14 over a substantial portion of its perimeter securely holding the utility platform assembly 210 in position. The ladder and rung grip support 268 securely holds the ladder side rail 12 as the ladder and rung grip support 268 in combination with the vertical support 218 wraps around a substantial portion of a ladder side rail 12.

By rotating the handle arm 219 away from the ladder side rail 12 with the handle 228 rotated upward so as to be parallel to the plane of the shelf 220 the top rung grip 264 and the bottom rung grip 262 are rotated away from the rung 14 permitting the palm 258 and finger 256 to be placed over the rung 14. After positioning the utility platform assembly 210 onto the ladder side rail 12 and rung 14 the handle 228 and handle arm 219 are rotated towards the ladder side rail 12 positioning the top rung grip 264 and the bottom rung grip 262 adjacent the rung 14 securely locking the utility platform assembly 210 onto the rung 14 and ladder side rail 12. The front ladder side rail support 285 is also rotated into position securely adjacent the ladder and rung grip support 268.

Figure 10A:
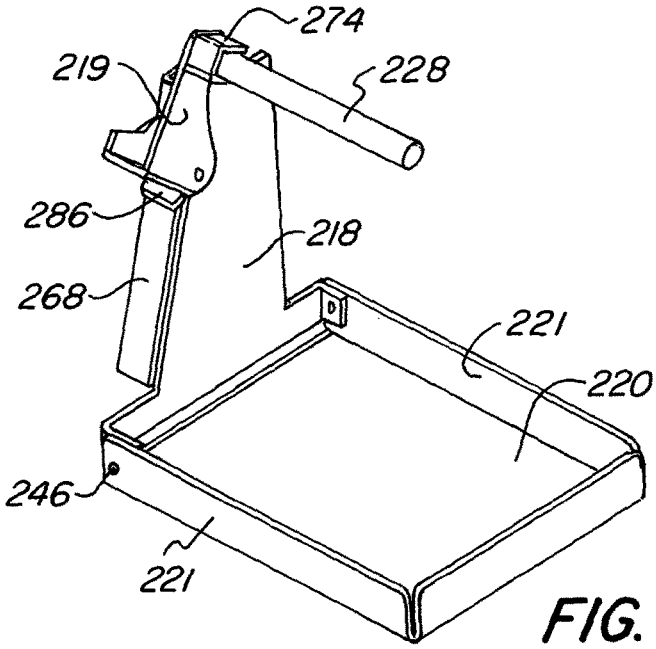
FIGS. 10A-C schematically illustrate another embodiment of the present invention in a carrying mode.
Figure 10B:
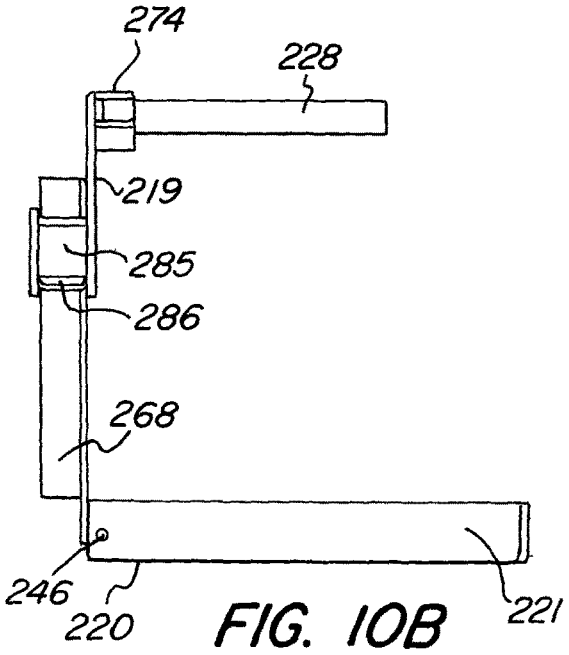
Figure 10C:
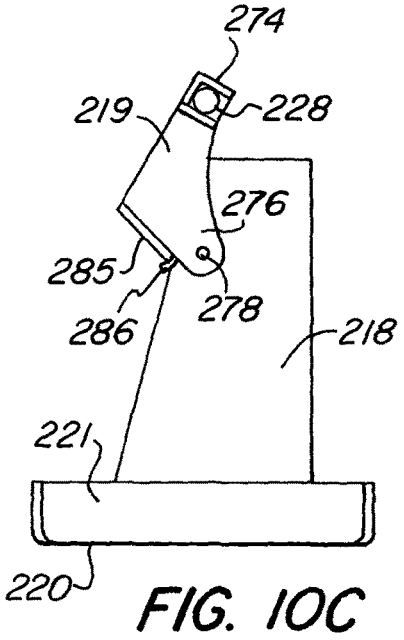

FIGS. 10A-C illustrate this other embodiment of the present invention of the utility platform assembly 210 in a carrying mode. The handle 228 is pivoted in position so as to be parallel to the plane of the shelf 220 the handle arm 219 and leg 276 rotate about the leg pivot 278 so that the axis of the handle 228 is over a center of the shelf 220. The handle stop 286 contacts the ladder and rung grip support 268 so as to prevent the handle arm 219 and handle 228 from rotating further. This makes the shelf 220 more stable and less prone to rocking.

Figure 11A:
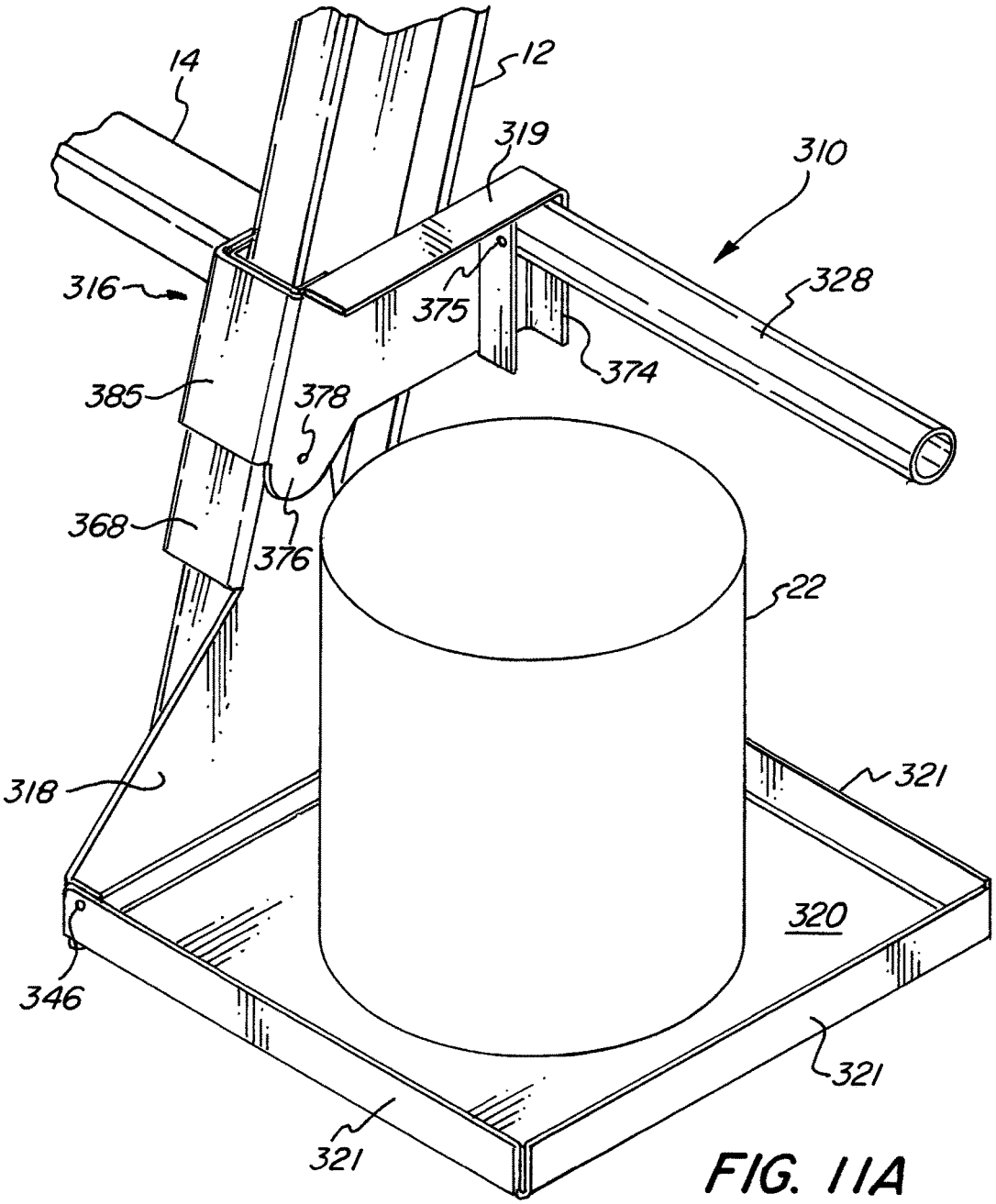
FIGS. 11A-B schematically illustrate another embodiment of the present invention substantially similar to the embodiment illustrated in FIGS. 8-11.
Figure 11B:
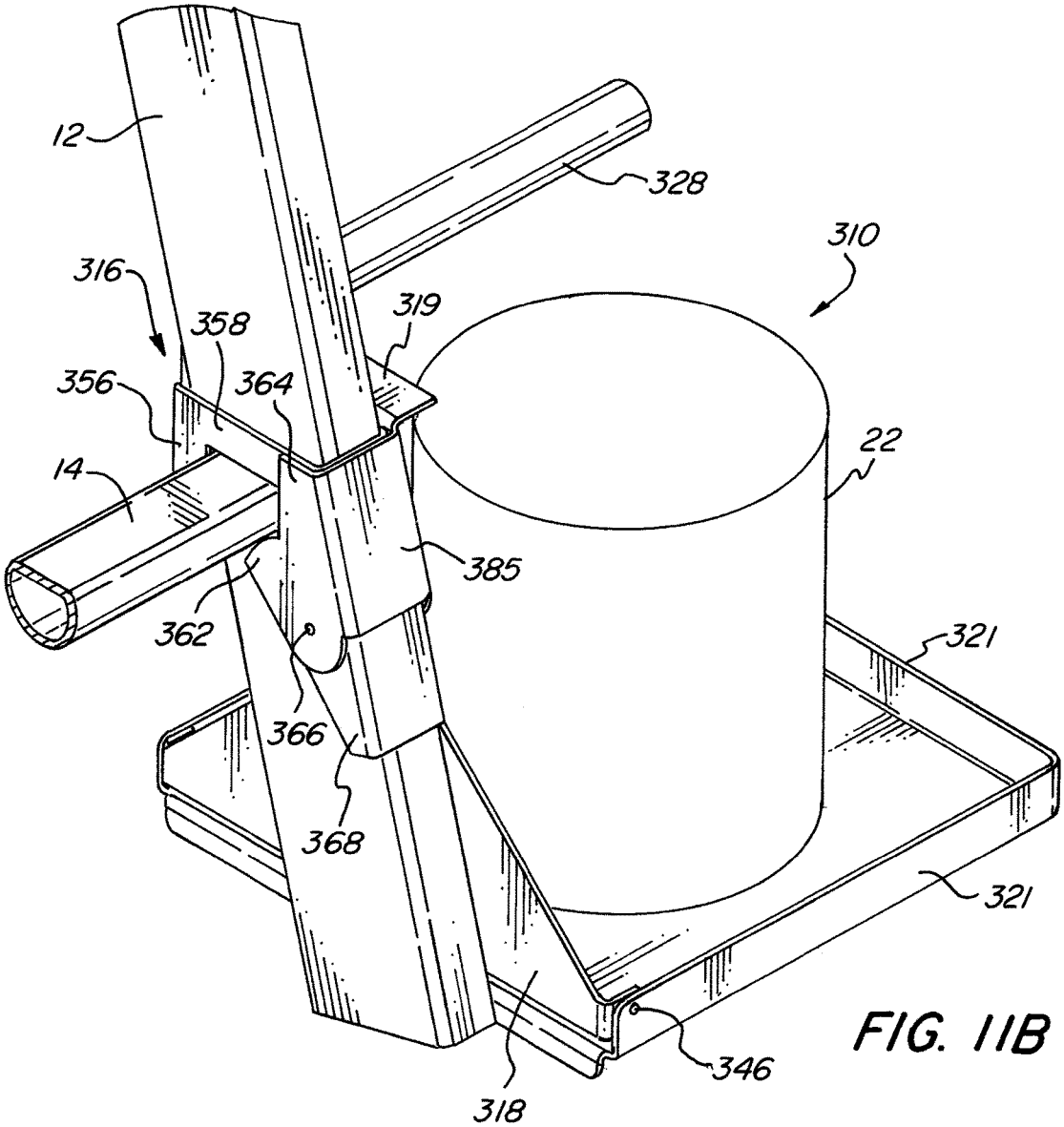

FIGS. 11A-B illustrate another embodiment of the present invention. This embodiment is substantially similar to the embodiment illustrated in FIGS. 8-11 but has a slightly different shape or configuration. The utility platform assembly 310 is attached to a ladder side rail 12 and rung 14 with a rung attachment mechanism 316. A handle arm 319 is attached to a vertical support 318 by pivot 378 on leg 376. The vertical support 318 is pivotally attached to a shelf 320 by pivot 346. The shelf 320 has side walls 321. Handle 328 is pivotally attached to the handle arm 319 by a pivot 375 and when retracted or folded is securely retained within the handle support 374. Front ladder side rail support 385 is pivoted into position about pivot 378 to be placed adjacent the ladder and rung grip support 368 which is placed adjacent the ladder side rail 12.

As illustrated in FIG. 11B, the rung 14 is held by palm 358 formed on the proximal end of the ladder and rung support 368 and a finger 356 placed on the distal end. Upon rotating the handle 328 forward and away from the ladder side rail 12 the front ladder side rail support 385 rotates about the pivot 366 placing the bottom rung grip or cam 362 and the top rung grip 364 into position adjacent the rung 14. The combination of the finger 356, palm 358, top rung grip 364, and bottom rung grip or cam 362 substantially encircles the rung 14 providing a secure attachment of the utility platform assembly 310 to the ladder.

The present invention provides a secure utility platform that may be easily attached to a rung of a ladder. Additionally, the structure of the present invention permits the utility platform assembly to be folded into a compact size that is easily carried or stored and unfolded when needed.

While the present invention has been described with respect to a preferred embodiment, it will be obvious to those skilled in the art that various modifications may be made without departing from the spirit and scope of the invention.

What is claimed is:

1. A utility platform for attaching to a rung and side rail of a ladder comprising:

a shelf;

a vertical support pivotally attached to said shelf;

a ladder and rung grip support formed on said vertical support, said ladder and rung grip support adapted to surround three sides of the side rail of the ladder;

a distal end formed on said ladder and rung grip support having an end finger and palm, the end finger and the palm adapted to hook over the rung of the ladder, the end finger and the palm contacting a first two adjacent side surfaces of the rung of the ladder;

a handle arm pivotally attached to said vertical support;

a rung grip having a top rung grip and a bottom rung grip attached to one end of said handle arm, the top rung grip and the bottom rung grip adapted to engage the rung of said ladder on a second two adjacent side surfaces of the rung of the ladder when said handle arm is pivoted relative to said vertical support;

wherein the end finger and the palm of said distal end formed on said ladder and rung grip support and the first two adjacent side surfaces of the rung of the ladder are positioned opposite to the top rung grip and bottom rung grip of said rung grip and the second two adjacent side surfaces of the rung of the ladder when the end finger and the palm are hooked over the rung of the ladder and the top rung grip and bottom rung grip are engaged with the rung of said ladder; and a handle attached to an opposing end of said handle arm, whereby said distal end is placed over the rung of the ladder and the handle arm is pivoted so as to engage the rung securely attaching the utility platform to the ladder.

2. A utility platform as in claim 1 wherein:

said handle arm has a pivot positioned above the rung when the utility platform is attached to the ladder.

3. A utility platform as in claim 1 wherein:

said handle arm has a pivot positioned below the rung when the utility platform is attached to the ladder.

4. A utility platform as in claim 1 wherein:

said handle pivotally attaches to said handle arm.

5. A utility platform as in claim 1 further comprising:

a latch coupling said shelf and said vertical support together when in a closed position adjacent each other.

6. A utility platform for attaching to a rung and side rail of a ladder comprising:

a shelf;

a vertical support pivotally attached to said shelf, wherein said vertical support can fold onto said shelf;

a ladder and rung grip support formed on said vertical support, said ladder and rung grip support having a ladder portion formed to contact three sides of the side rail of the ladder and said ladder and rung grip support comprising a palm formed to contact a top surface of the rung and a finger formed to contact a first side surface of the rung;

a handle arm pivotally attached by a pivot to said ladder and rung grip support, said handle arm having a top rung grip formed to contact a second side surface of the rung opposite the first side surface of the rung contacted by the finger of said ladder and rung grip support, and a bottom rung grip formed to contact a bottom surface of the rung between the first side surface of the rung contacted by the finger and the second side surface of the rung contacted by the top rung grip formed on said handle arm; and a handle pivotally attached to said handle arm on an end of said handle arm opposite the pivot attaching said handle arm to said ladder and rung grip support, whereby when said handle arm is rotated with said handle in a first direction said handle arm rotates about the pivot placing the bottom rung grip and the top rung grip into position adjacent the rung encircling the rung with the finger, the palm, the top rung grip, and the bottom rung grip securing the utility platform to the rung, and when said hand arm is rotated with said handle in a second direction opposite to the first direction said handle arm rotates about the pivot moving the bottom rung grip and the top rung grip away from the rung permitting the utility platform to be removed from the rung.

* * * * *